US009816236B2

(12) United States Patent
Loomis et al.

(10) Patent No.: US 9,816,236 B2
(45) Date of Patent: Nov. 14, 2017

(54) DEVICE FOR REINSTATEMENT OF A MICRO-TRENCH

(71) Applicant: Willamette Valley Company, Eugene, OR (US)

(72) Inventors: Robert Loomis, Aliso Viejo, CA (US); Jacob Goodwin, Creswell, OR (US)

(73) Assignee: Williamette Valley Company, Eugene, OR (US)

( * ) Notice: Subject to any disclaimer, the term of this patent is extended or adjusted under 35 U.S.C. 154(b) by 0 days.

(21) Appl. No.: 15/070,530

(22) Filed: Mar. 15, 2016

(65) Prior Publication Data

US 2017/0268183 A1 Sep. 21, 2017

(51) Int. Cl.
*E01C 19/12* (2006.01)
*E01C 23/09* (2006.01)

(52) U.S. Cl.
CPC ..... *E01C 23/0966* (2013.01); *E01C 19/12* (2013.01)

(58) Field of Classification Search
CPC ..... E01C 23/0966; E01C 19/12
USPC ..... 404/84.05, 101, 105–111, 113, 118–121; 405/155
See application file for complete search history.

(56) References Cited

U.S. PATENT DOCUMENTS 992,359 A 5/1911 Kenney
1,212,906 A 1/1917 Clark
1,543,922 A 6/1925 Humphreys et al.
2,030,045 A 2/1936 Billings
2,682,716 A 7/1954 Burkholder
3,015,261 A 1/1962 MacDonald
3,181,258 A 5/1965 Duncan
4,502,814 A * 3/1985 Trimble ..... E01C 23/0973 401/265
4,555,286 A * 11/1985 Orikasa ..... E04G 23/0203 141/1
4,630,965 A * 12/1986 Nguyen ..... C08L 95/00 222/175
5,236,275 A * 8/1993 Kneeland ..... E01C 19/4826 404/107

(Continued)

FOREIGN PATENT DOCUMENTS

EP 0164242 B1 12/1989

OTHER PUBLICATIONS

FastPatch DPR Info, downloaded from the Internet, FastPatch@wilvaco.com; 2 pages.

(Continued)

*Primary Examiner* — Raymond W Addie
(74) *Attorney, Agent, or Firm* — Brinks Gilson & Lione

(57) ABSTRACT

A device for reinstatement of a micro-trench that includes a hopper. The hopper includes a top opening and a bottom opening, the top opening being larger than the bottom opening. The device also includes a valve portion connected to the bottom opening of the hopper and a tube connected to the valve portion. The device also includes a dynamic plate portion including a top opening, a bottom opening, and a conduit between the top and bottom openings. The top opening of the plate portion is connected to the tube, and the bottom opening includes a length and a width. The dynamic plate portion allows the device to maintain positive contact with the pavement even when the surface of the pavement is angled or uneven.

21 Claims, 9 Drawing Sheets

(56) References Cited

U.S. PATENT DOCUMENTS 5,333,969 A * 8/1994 Blaha ..... E01C 19/46 404/102
5,857,804 A * 1/1999 Musil ..... E01C 19/48 404/104
6,089,785 A * 7/2000 Bergman ..... E01C 19/488 404/101
6,290,428 B1 * 9/2001 Hall ..... E01C 23/0973 15/103.5
6,612,774 B1 * 9/2003 Dulin ..... E01C 19/266 404/104
7,255,512 B2 8/2007 Wallace
8,167,513 B2 * 5/2012 Ryan ..... E01C 23/06 404/101
8,297,879 B1 * 10/2012 Schmidt ..... E01H 1/003 172/811
8,480,332 B2 7/2013 Miller
8,562,249 B2 10/2013 Owegeser
2002/0044830 A1 4/2002 Munie
2010/0239370 A1 * 9/2010 Hill ..... E01C 19/48 404/108
2010/0322710 A1 * 12/2010 Ryan ..... E01C 23/06 404/78
2011/0182664 A1 * 7/2011 Brodie ..... E01C 23/098 404/107
2011/0200389 A1 * 8/2011 Whitley ..... E01C 23/06 404/101
2014/0144051 A1 5/2014 Sewell

OTHER PUBLICATIONS

Micro-trench Reinstatement, Technical Advice Note 11-09, TAN11-09 Micro-trench reinstatement Issue 2, 2011, 10 pages.

* cited by examiner 126
122d
122a
138a
124a
132
122c
136
122b
124b
128
122e
138b
120
114a
134
118a
108a
108d
103
116
118b
108b
110
110a
114b
130

DEVICE FOR REINSTATEMENT OF A MICRO-TRENCH

BACKGROUND

1. Technical Field Text

The present invention relates to a device used for reinstatement of a micro-trench in pavement.

2. Background Information

Fibre broadband is a type of broadband that uses fibre optic cables to increase the speed of a broadband connection. An extensive network of fibre optic cables allows for fibre to the property (FTTP) or fibre to the home (FTTH) connections to make fibre broadband available to commercial and residential customers. To create such an extensive network, fibre optic cables or a duct of fibre optic cables may be installed in a road, such as a highway surface or pavement, or a footway, such as a sidewalk or pavement, that provides a protected structure for the fibre optic cables or the duct of fibre optic cables.

The installation of fibre optic cables in existing pavement requires creating or cutting a trench in the pavement, laying of the fibre optic cables, and then backfilling of the trench. In the past, open trench excavation has been used to create trenches in pavement to conduct, for example, sewer construction, repair or replacement. However, open trench excavation is time-consuming, expensive and disruptive to traffic, pedestrians and residents, especially when roads need to be closed to conduct the open trench excavation.

Micro-trench machines have been developed to create micro-trenches within pavement and lay the fibre optic cables within the micro-trenches. The micro-trenches are smaller in size than open trench excavation and less disruptive to traffic, pedestrians and residents. These micro-trench machines also create an efficient method of creating or cutting micro-trenches and laying the fibre optic cables within the micro-trenches. After the micro-trench has been created and the fibre optic cables have been laid in the trench, the micro-trench needs to be backfilled and the pavement repaired to its original level and condition. This process is known as reinstatement. In the past, reinstatement of a micro-trench has been conducted manually or using a machine that is unable to precisely and accurately pour the backfill material into the micro-trench and also have the pavement repaired to its original level and condition.

For example, with manual reinstatement, a person will position a duct, hose or similar tubing within the micro-trench and backfill material will flow from the duct into the micro-trench. The person will walk along the length of the micro-trench with the duct to backfill the micro-trench. The manual reinstatement of micro-trenches is inefficient and expensive. Specifically, a person has to walk every inch of pavement where a micro-trench has been created to backfill the micro-trench and level out the backfill material to restore the pavement to its original level and condition. This manual process requires significant manpower and elongates disruption to road users, communities and residents.

As the installation speed of fibre optic cables is essential to serve future customers, a need exists for devices and methods that provide fast deployment of a reinstatement material into the micro-trenches and restore the pavement to its original level and condition prior to micro-trenching.

BRIEF SUMMARY

This invention concerns devices and processes used for reinstatement of a micro-trench that increase the speed of reinstatement and maintain the integrity and level of the pavement after reinstatement.

In one aspect, the present invention relates to a device for reinstatement of a micro-trench that includes a hopper. The hopper includes a top opening and a bottom opening, the top opening being larger than the bottom opening. The device also includes a valve portion connected to the bottom opening of the hopper and a tube connected to the valve portion. The device also includes a dynamic plate portion including a top opening, a bottom opening, and a conduit between the top and bottom openings. The top opening of the plate portion is connected to the tube, and the bottom opening includes a length and a width.

In another aspect, the present invention relates to a machine-powered device for reinstatement of a micro-trench that includes a hopper. The hopper includes a top opening and a bottom opening, the top opening being larger than the bottom opening. The device also includes a valve portion connected to the bottom opening of the hopper and a flexible tube connected to the valve portion. The device also includes a plate portion that includes a top opening, a bottom opening, and a conduit between the top and bottom openings. The top opening of the plate portion is connected to the flexible tube.

In another aspect, the present invention relates to a machine-powered device for reinstatement of a micro-trench that includes a frame support. The device also includes a hopper that is positioned within the frame support and is rotatably connected to the frame support. The device also includes a valve portion that is connected to the bottom opening of the hopper and a flexible tube that is connected to the valve portion. Also, the device includes a plate portion that includes a top opening, a bottom opening, and a conduit between the top and bottom openings. The top opening of the plate portion is connected to the flexible tube and the bottom opening includes a length and a width.

The accompanying drawings, which are incorporated herein and constitute part of this specification and, together with the general description given above and the detailed description given below, serve to explain features of the present invention.

DETAILED DESCRIPTION OF THE DRAWINGS AND THE PRESENTLY PREFERRED EMBODIMENTS

Figure 1:
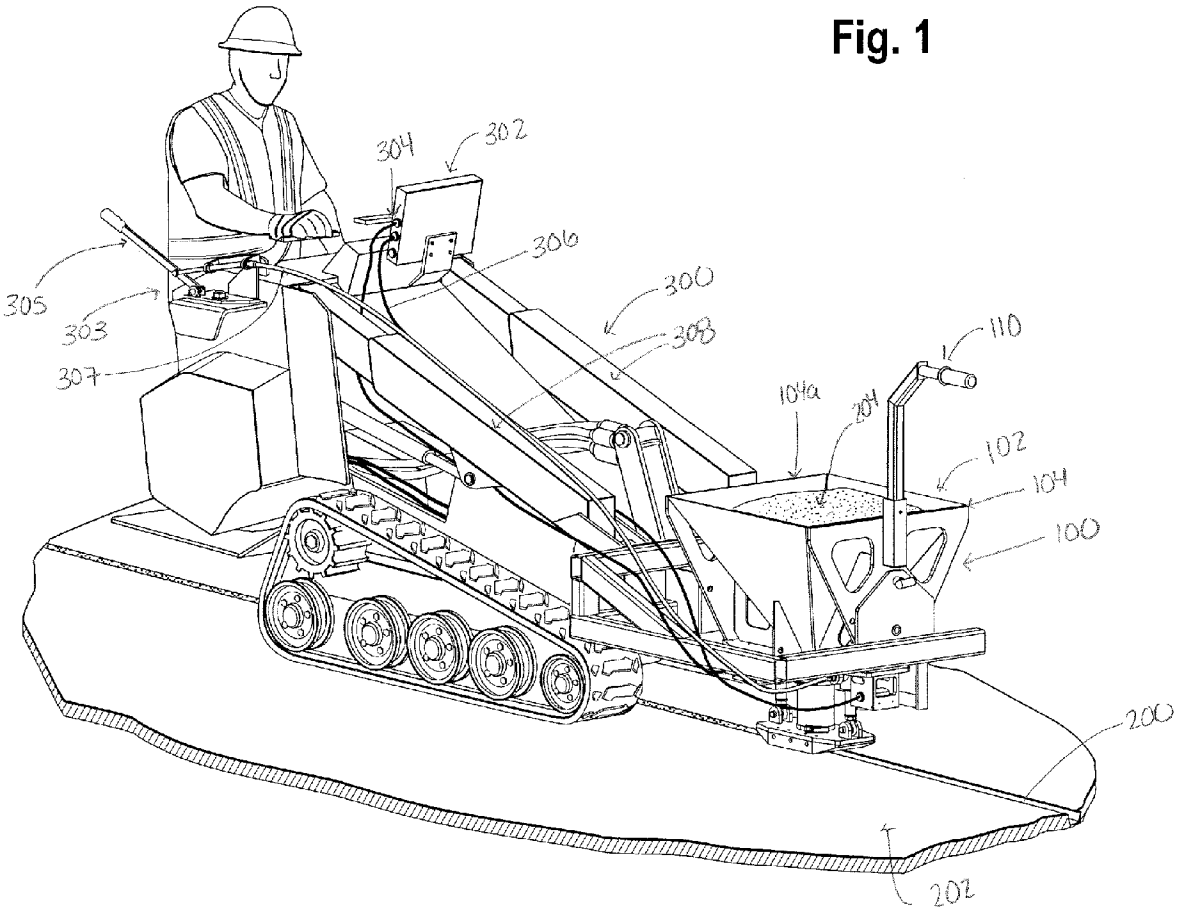
FIG. 1 shows a perspective view of an embodiment a machine-powered device for reinstatement of a micro-trench in use.

FIGS. 1-8 show an embodiment of a device 100 for reinstatement of a micro-trench 200. As shown in FIG. 1, the micro-trench 200 includes a width, a length, and a depth and is formed within pavement 202. The pavement 202 may include asphalt, concrete or cement. As described above, after the micro-trench 200 has been created and fibre optic cables have been laid in the micro-trench 200, the micro-trench 200 needs to be backfilled with material 204 and the pavement 202 repaired to its original level and condition. This process is known as reinstatement.

The material 204 used to reinstate the micro-trench 200 may include a polymer blend of recycled and renewable materials, such as FastPatch DPR made by Willamette Valley Company, or other repair material for distressed pavement. The material 204 may be fast-curing with a cure time of less than approximately 45 minutes and may be applied in warm or cooler climates. The fast-curing property of the material 204 increases the efficiency of the reinstatement process and minimizes traffic interruptions. The material 204 may also be used with an accelerator, such as the FastPatch Kicker made by Willamette Valley Company, to further decrease the curing time of the material 204.

To advance or push the device 100 along the pavement 202 to reinstate the micro-trench 200, the device 100 may be attached to a machine 300 as shown in FIG. 1. The machine 300 used may be one known in the art, such as a Ditch-Witch® SK850, that is engine-powered and in this embodiment supplies the necessary power and force to push the device 100 along the pavement 202 over the micro-trench 200. The machine 300 may include one or more forks or arms 308 connected to a mount plate (not shown). The mount plate is used to attach the device 100 to the machine 300. When the device 100 is attached to the machine 300, the arms 308 of the machine 300 allow the machine 300 to lift or lower the device 100 and position the device 100 over the micro-trench 200.

The propulsion force applied to the device 100 by the machine 300 must be sufficient to overcome the static friction between the device 100 and the pavement 202 to advance the device 100 along the pavement 202. When the device 100 is filled with material 204, the weight of the device 100 with the material 204 may create a significant force of static friction requiring the power of the machine 300 to supply the necessary force to overcome the force of static friction. The amount of propulsion force necessary to overcome the force of static friction depends on the size of the device 100 and the amount of material 204 within the device 100 at a particular time during use. Thus, the amount of force necessary may vary, i.e. be smaller or larger, depending on the size of the device 100 and the amount of material 204 within the device 100.

The machine 300 may also include a display 302 mounted on a dash of the machine 300 that displays diagnostics and other readouts of the machine 300. The display 302 also includes a plurality of cable connections 304 for connecting cables 306 between the device 100 and the display 302. The machine 300 may also include a lever assembly 303 including a mechanical lever 305, a rod 307, and a connecting cable 309 positioned within the rod 307, for use with a valve portion of the device 100, described in greater detail below.

Figure 3:
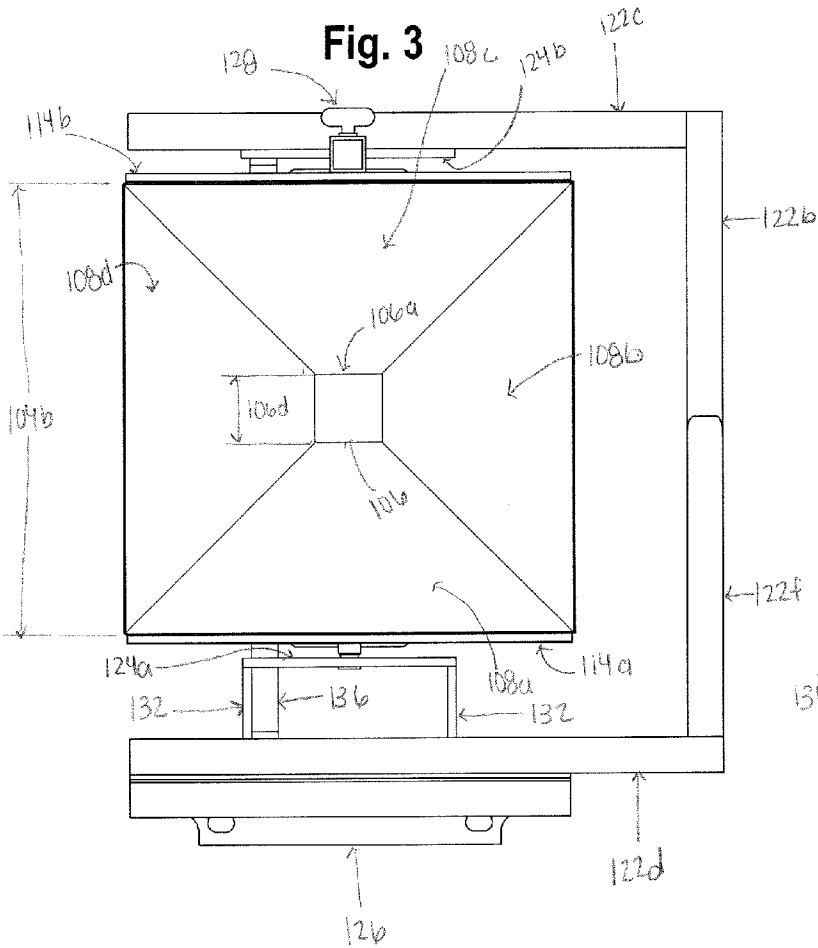
FIG. 3 shows a top view of the device of FIG. 1.
Figures 7A, 7B:
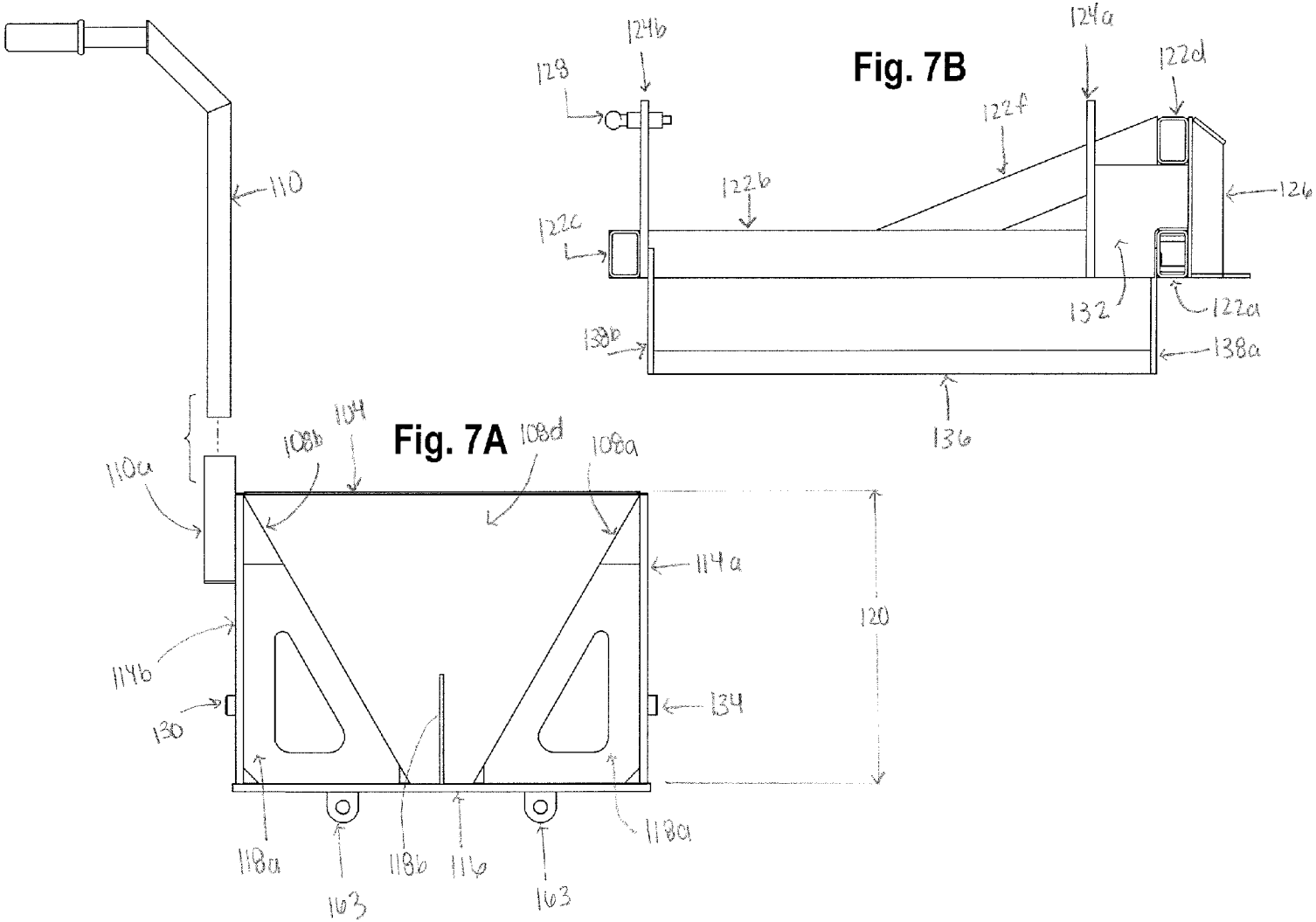
FIG. 7A shows a side view of a hopper and a sub-frame assembly of the device of FIG. 1.
FIG. 7B shows a side view of a frame of the device of FIG. 1.

As shown in, for example, FIGS. 1 and 3, the device 100 includes a hopper 102 that includes a top 104, a top opening 104*a*, a bottom 106, a bottom opening 106*b*, one or more walls 108 that taper from the top 104 to the bottom 106 of the hopper 102, and a depth 120, as shown in FIG. 7A. The hopper 102 is a container for the material 204 that tapers downward and is able to discharge the material 204 through the bottom opening 106*a*. The hopper 102 may include a rectangular, square or circular shape, and the top opening 104*a* and bottom opening 106*a* may also include a corresponding rectangular, square or circular shape. The hopper 102 as described herein is described having a square shape for illustration purposes and includes four walls 108*a*, 108*b*, 108*c*, and 108*d*. The top opening 104*a* includes a width 104*b* larger than a width 106*b* of the bottom opening 106*a*, as shown in FIG. 3.

The material of the hopper 102 may include steel, iron, other metal alloys, plastics, or a material that is adhesion resistant and chemical resistant. The dimensions of the hopper 102 may vary to accommodate a specific volume of material 204. For example, the hopper 102 may be able to accommodate 12 to 15 gallons of material 204; however, the hopper 102 may also be able to accommodate more or less than 12-15 gallons of material 204 depending on its dimensions. As a result of the fast-curing property of the material 204, some material 204 may affix to the walls 108 of the hopper 102 during the reinstatement process. To prevent buildup of material 204 along the walls 108, the walls 108 may include a smooth surface to allow for easy scraping of the material 204 off of the walls 108. A liner or other material, such as a type of grease, may also be applied to the walls 108 of the hopper 102 to help prevent buildup of material 204 on the walls 108 of the hopper 102 and ease removal of excess material 204 from the walls 108.

The material 204 may be poured into the top opening 104*a* of the hopper 102 either manually through a tube, pump or similar device after the material 204 is mixed or using a machine that may mix the material 204 and pour the material 204 into the hopper 102. If a machine is used, the machine may travel alongside the machine 300 during operation to refill the hopper 102 with material 204.

Figure 2:
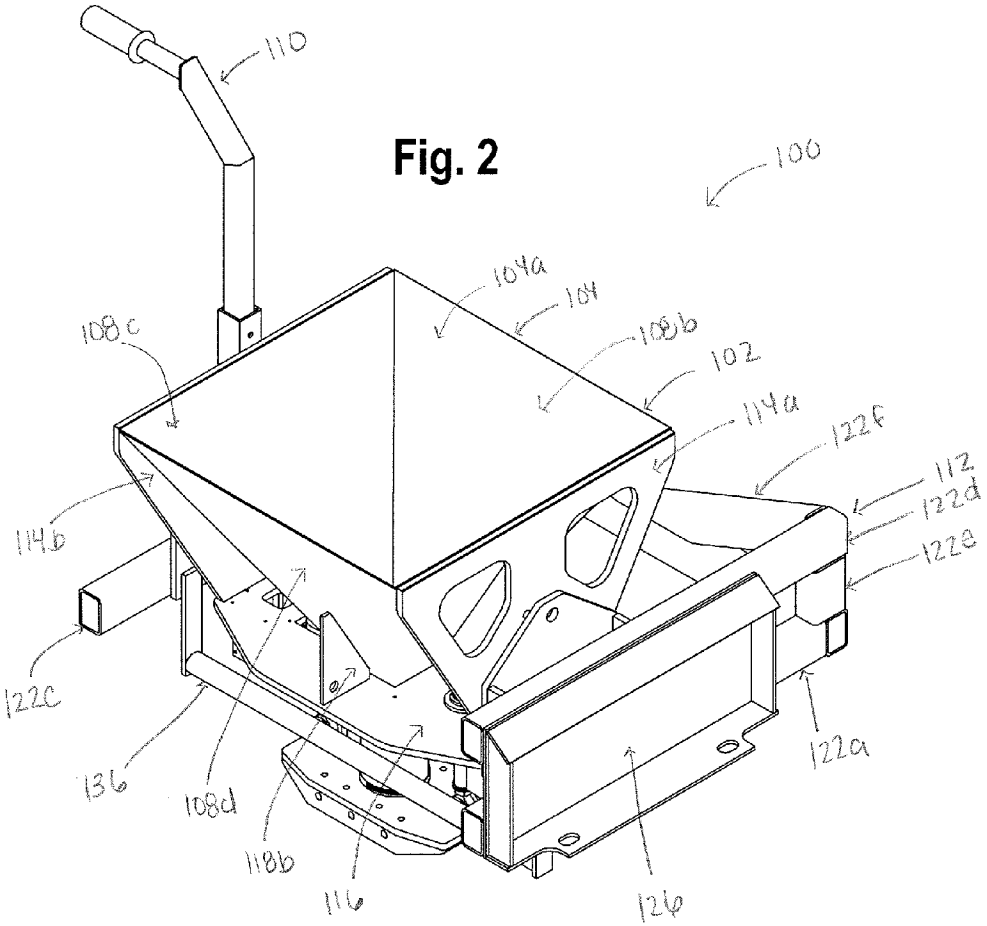
FIG. 2 shows a perspective view of the device of FIG. 1 in an operating position.

As shown in FIG. 2, the device 100 also includes a frame 112 for supporting the hopper 102. For attachment between the frame 112 and the hopper 102, the device 100 may include a sub-frame assembly that may be integral within the hopper 102 via a weld, bond, or adhesive. The material of the sub-frame assembly may be the same as the material of the hopper 102 and may include steel, iron, other metal alloys, plastics, or a material that is adhesion resistant and chemical resistant.

The sub-frame assembly includes at least two vertical side panels 114*a*, 114*b*, a bottom panel 116, and at least four triangular support panels 118 including two large triangular support panels 118*a* and two small triangular support panels 118*b*. FIG. 7A shows a side view of the hopper 102 and the sub-frame assembly. The sub-frame assembly provides support for the hopper 102 and a surface for connection of the hopper 102 to the frame 112 without creating holes for pins, screws, bolts, or other mechanical fasteners into the walls 108 of the hopper 102, which allows the walls 108 of the hopper 102 to maintain a smooth surface as discussed above.

As shown in FIGS. 2-3 and 7A, the at least two vertical side panels 114*a* and 114*b* correspond with two opposing walls 108*a* and 108*c* of the hopper 102. The side panels 114*a*, 114*b* may include a top, a bottom, a length, and two sides that taper from the top to the bottom. Thus, the width of the top of each side panel 114*a*, 114*b* may be larger than the width of the bottom of each side panel 114*a*, 114*b*. Each side panel is connected to the top 104 of the hopper 104 along the width of the corresponding wall 108*a*, 108*c* and then extends vertically for a length, which is the same as the depth 120 of the hopper 102. The bottom of each side panel 114*a*, 114*b* is connected to the bottom panel 116 of the sub-frame assembly.

The bottom panel 116 of the sub-frame assembly includes a length and a width, which correspond with the length and width of the top opening 104*a* of the hopper 102, and is positioned concentrically below the top opening 104*a* of the hopper 102. The bottom panel 116 is connected to the bottom 106 of the hopper 102 and includes an opening that corresponds with the bottom opening 106*a* of the hopper 102 to allow material 204 to pass through the opening of the bottom panel 116.

The triangular support panels 118*a* are positioned on the top surface of the bottom panel 116 and between each side panel 114*a*, 114*b* and each corresponding wall 108*a*, 108*c* of the hopper 102, as shown in FIG. 7A. The triangular support panels 118*a* support the hopper 102 and prevent movement of the hopper 102 toward the side panels 114*a*, 114*b*. As described above, the triangular support panels 118*b* may be smaller than the triangular support panels 118*a*. The triangular support panels 118*b* may also be positioned on the top surface of the bottom panel 116 and connected to the remaining two walls 108*b*, 108*d* of the hopper 102 to support the hopper 102 and also prevent movement of the hopper 102. Thus, the at least four triangular support panels 118 prevent lateral (sideways) and longitudinal (forward and backward) movement of the hopper 102 within the sub-frame assembly.

Figure 8:
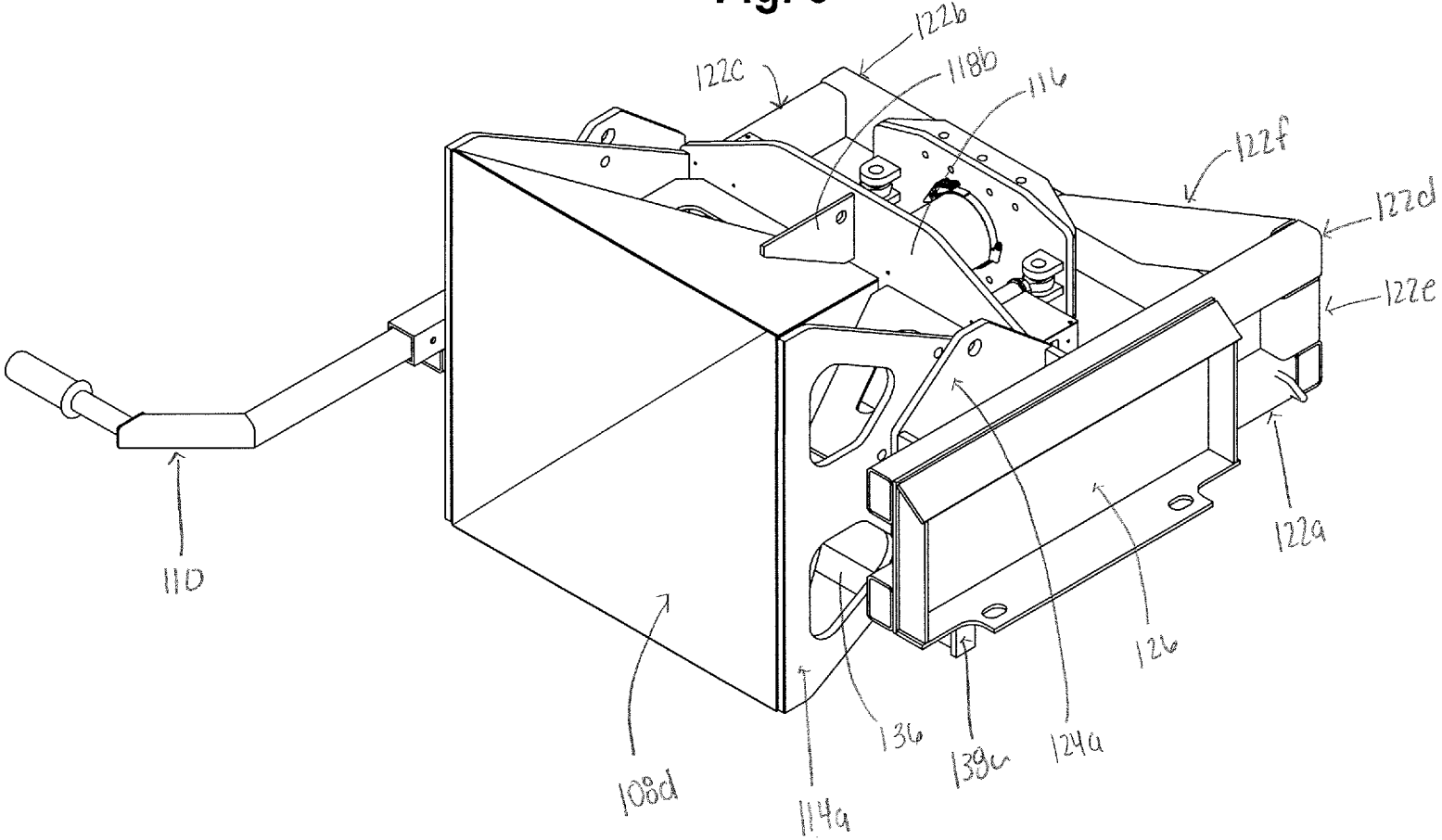
FIG. 8 shows a perspective view of the device of FIG. 1 in a servicing position.

The device 100 may also include a handle 110 attached to one of the side panels 114 of the sub-frame assembly. As shown in FIGS. 2 and 7A, the handle 110 may be attached to panel 114*b* of the sub-frame assembly. The handle 110 may be positioned within and mechanically fastened to a rectangular slot 110*a* that is connected to the side panel 114*b* of the sub-frame assembly, as shown in FIG. 7A. The handle 110 provides a mechanism for an operator to manipulate movement of the device 100. For example, the handle 100 may be used for an operator to grip and push or pull the device 100 when the device 100 is not attached to the machine 300. The handle 100 may also be used to facilitate rotation of the hopper 102 of the device 100 from an operating position, as shown in FIGS. 1-6, to a servicing position for cleaning and servicing the hopper, as shown in FIG. 8.

The sub-frame assembly is rotatably connected to the frame 112 of the device 100 via the side panels 114*a*, 114*b* of the sub-frame assembly. The ability to rotate the sub-frame assembly, which rotates the hopper 102, allows the hopper 102 to transition from the operating position to the servicing position. The material of the frame 112 may be the same as the sub-frame assembly and may include steel, iron, other metal alloys, plastics, or a material that is adhesion resistant and chemical resistant. As shown in FIGS. 2-6 and 7B, the frame 112 partially surrounds the sub-frame assembly and the hopper 102 and includes a plurality of interconnected bars 122, at least two connecting panels 124*a*, 124*b*, and a mount 126. The bars 122 may be mechanically fastened, via screws, bolts, nuts, and/or washers, together or integral with each other via a weld, bond, or adhesive. The panels 124*a*, 124*b* may include a generally pentagon or triangular shape.

As shown in FIGS. 2-6 and 7B, three of the bars 122*a*, 122*b*, 122*c* partially surround the hopper 102. A fourth bar that would be connected to bars 122*a* and 122*c* to form a square is not included to allow the hopper 102 to rotate from the operating position to the servicing position, as shown in FIG. 8. Beginning with the bar 122*c*, the bar 122*c* has one free end portion and one end portion connected to the bar 122*b* and is generally parallel to wall 108*c* of the hopper 102. The bar 122*c* is also connected to one of the connecting panels 124*b* along part of the length of bar 122*c*, as shown, for example, in FIG. 3. The bar 122*c* may be mechanically attached to the connecting panel 124*b*, via screws, bolts, nuts, and/or washers, or attached to the connecting panel via welding, bonding, or adhesive. The connecting panel 124*b* is then connected to panel 114*b* of the sub-frame assembly.

Figure 6:
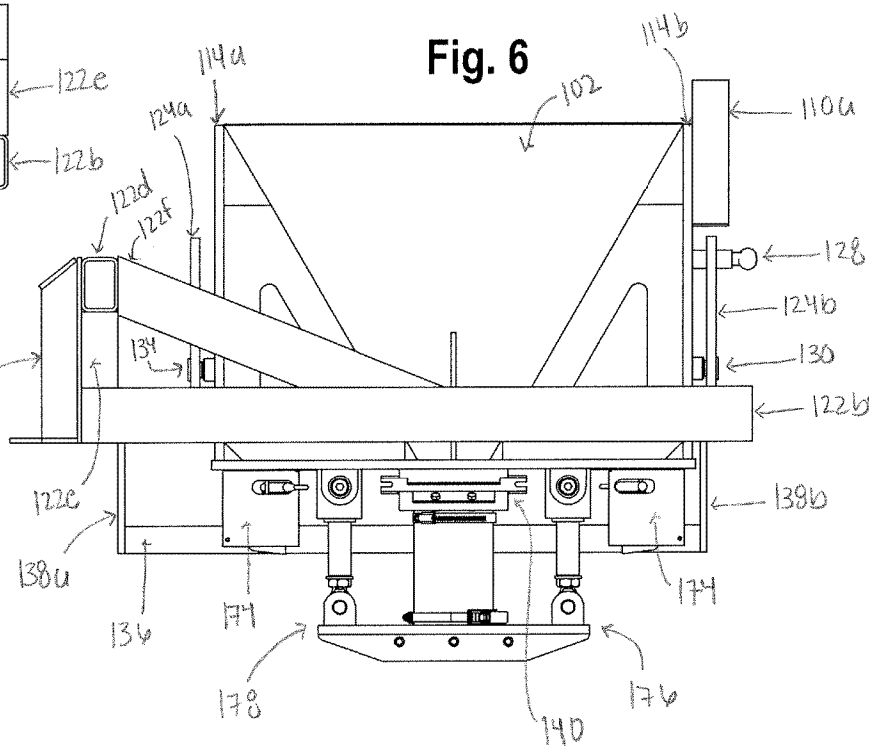
FIG. 6 shows a side view of the device of FIG. 1.

As shown in FIGS. 2-3, 6, and 7B, the connecting panel 124*b* is mechanically connected to panel 114*b* of the sub-frame assembly to support the sub-frame assembly yet also allow the sub-frame assembly and the hopper 102 to rotate between the operating and servicing positions. For example, as shown in FIGS. 6 and 7A, the panel 124*b* may be mechanically fastened to panel 114*b* at approximately the center of panel 124*b* at attachment location 130.

The connecting panel 124*b* may also be connected to panel 114*b* via a rod with a corresponding handle 128, as shown in, for example, FIG. 6. The panel 114*b* may include one or more holes (not shown) for insertion of the rod 128 through one of holes. The holes may be positioned in a series adjacent to one another such that when the hopper 102 is the operating position, the rod 128 may be inserted through the middle of the three holes to lock the hopper 102 in position. When the hopper 102 is rotated from the operating position into the servicing position, the rod 128 is pulled out, the hopper 102 is rotated, for example using the handle 110, and the rod 128 is inserted back into one of the adjacent holes to lock the hopper 102 in the servicing position. Once the hopper 102 has been cleaned or the remaining material 204 removed, the rod 128 is removed from the hole, the hopper 102 is rotated back to the operating position, and the rod 128 is inserted back into the middle of the three holes to lock the hopper 102 in the operating position.

Figure 4:
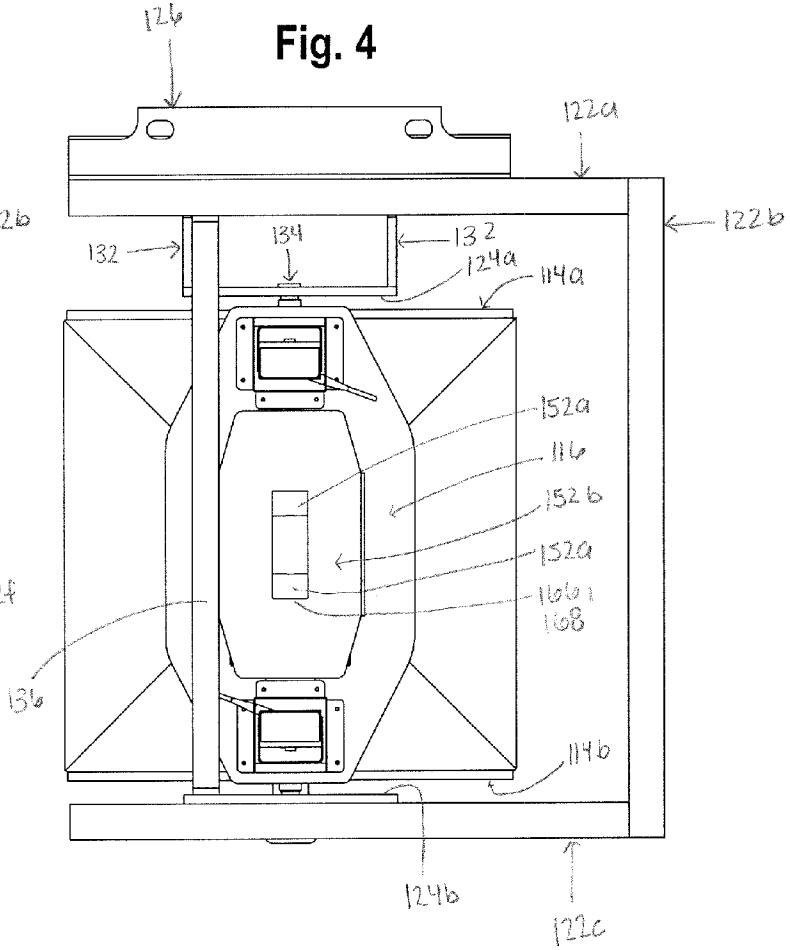
FIG. 4 shows a bottom view of the device of FIG. 1.

As shown in FIGS. 3-4 and 7B, the bar 122*b* of the frame 112 is connected at both of its end portions with one end portion connected to bar 122*c* and the other end portion connected to bar 122*a*. The bar 122*b* is generally parallel to wall 108*b* of the hopper 102 and is not directly connected to either the hopper 102 or the sub-frame assembly. The bar 122*a* of the frame 112, similar to bar 122*c*, has one free end portion and one end portion connected to bar 122*b*. The bar 122*a* is generally parallel to wall 108*a* of the hopper 102. As shown in FIG. 2, another bar 122*d* is positioned above and parallel to bar 122*a*. The two bars 122*a* and 122*d* provide points of attachment for the mount 126 of the frame 112, described in more detail below. As shown in FIGS. 2 and 6, another bar 122*e* connects bars 122*a* and 122*d* and is perpendicular to bars 122*a*, 122*d*. Another bar 122*f* is connected to bars 122*b*, 122*d*, and 122*e* to support bars 122*d* and 122*e*. The bar 122*f* is angled with respect to bar 122*b*.

The mount 126 of the frame 112 is connected to bars 122*a*, 122*d* of the frame 112 via a mechanical connection, such as screws, bolts, nuts, and/or washers, or via an integral connection, such as a weld, bond or adhesive, as shown in FIG. 2. The mount 126 attaches to the mount plate of the machine 300 for attachment of the device 100 to the machine 300. As described above, the mount plate of the machine 300 is connected to the arms 308 of the machine 300, which allow the machine 300 to lift or lower the device 100 and position the device 100 over the micro-trench 200.

To connect bars 122*a*, 122*d* and the mount 126 to the sub-frame assembly, the frame 112 may also include two L-shaped panels 132, as shown in FIGS. 3-4 and 7B. The L-shaped panels 132 are positioned between the mount 126, the bars 122*a*, 122*d*, and the connecting panel 124*a*. The L-shaped panels 132 are welded, bonded, or adhered to the mount 126 and the connecting panel 124*a*.

Similar to the connecting panel 124*b*, the connecting panel 124*a* is mechanically connected to panel 114*a* of the sub-frame assembly to support the sub-frame assembly and the hopper 102 yet also allow the hopper 102 to rotate between the operating and servicing positions. The connecting panel 124*a* may be mechanically fastened to panel 114*a* at approximately the center of panel 124*a* at attachment location 134. Similar to the connecting panel 124*b*, the connecting panel 124*a* may also be connected to panel 114*a* via a rod with a corresponding handle (not shown). The rod would serve the same purpose as rod 128, i.e. to lock the hopper 102 in place in either the operating position or servicing position, and the panel 114*a* may include one or more corresponding holes for insertion of the rod through one of holes.

The frame 112 may also include a shaft 136, as shown in FIGS. 2, 4, 6, 7B and 8. The shaft 136 is positioned under the hopper 102, when the hopper 102 is in the operating position, and is generally parallel the bar 122*b*. Each end of the shaft 136 is attached to a rectangular connecting panel 138. As shown in FIG. 7B, one of the rectangular connecting panels 138*a* is connected to the bar 122*a*, and the other rectangular connecting panel 138*b* is connected to panel 124*b* of the frame 112.

The connecting panels 138*a*, 138*b* may be connected to the bar 122*a* and the panel 124*b*, respectively, via a mechanical connection, such as screws, bolts, nuts, and/or washers, or via an integral connection, such as a weld, bond, or adhesive. The connecting panels 138*a*, 138*b* position the shaft 136 below the bars 122*a*, 122*b*, 122*c* and closer to the ground. The shaft 136 provides a stop for the hopper 102 when the hopper 102 is rotated from the operating position to the servicing position, as shown in FIG. 8. Specifically, the shaft 136 prevents the hopper 102 from rotating any further beyond the shaft 136 and also provides a surface for the hopper 102 to position on top of in the servicing position.

The device 100 may also include a plurality of legs (not shown) connected to the bars 122*a*, 122*b*, 122*c* of the frame 112 of the device 100. Each leg may include a wheel (not shown) to facilitate movement of the device 100 when the device 100 is not attached to the machine 300.

Figure 7D:
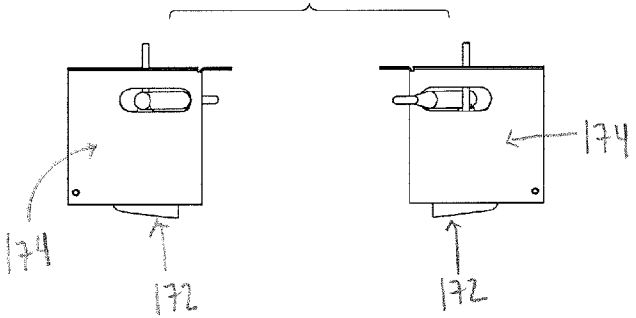
FIG. 7D shows a side view of two cameras of the device of FIG. 1.
Figure 7C:
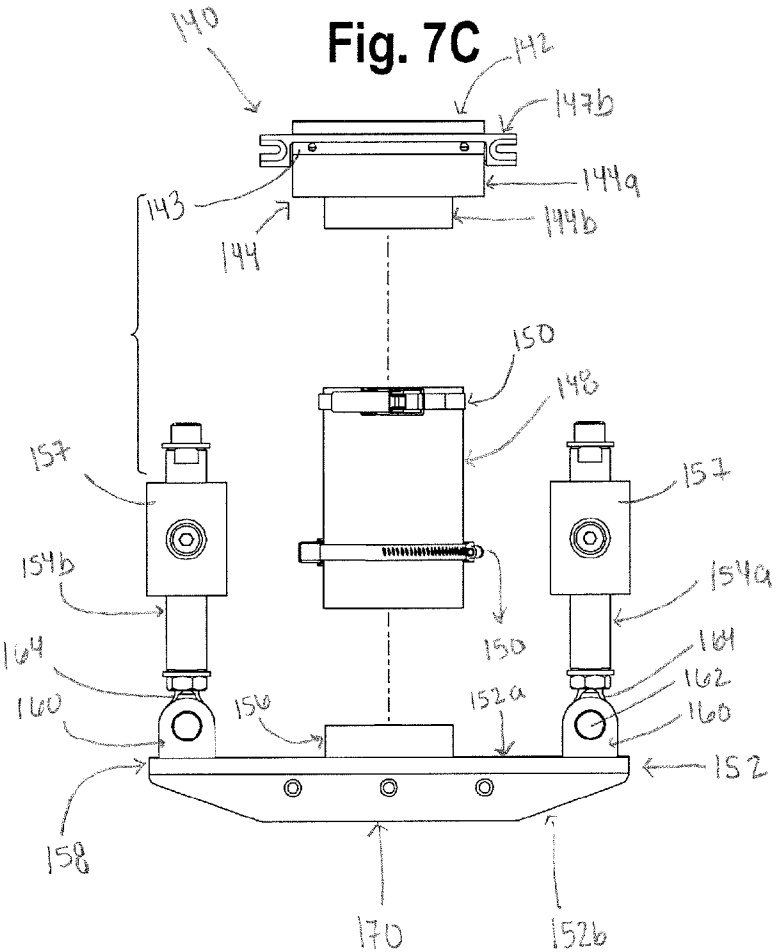
FIG. 7C shows a side view a valve portion, a tube, a plate portion, and two shafts of the device of FIG. 1.
Figure 7F:
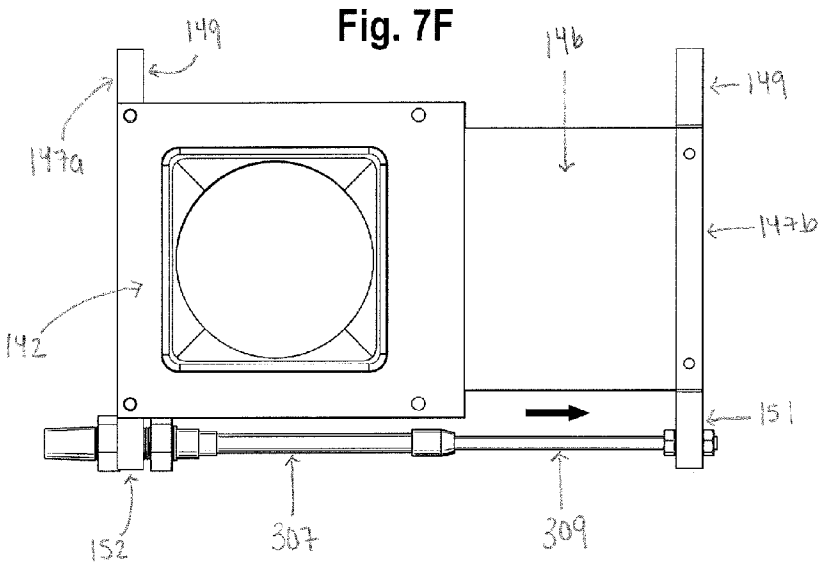
FIG. 7F shows a top view of the valve of the device of FIG. 1 in the open position.
Figure 7E:
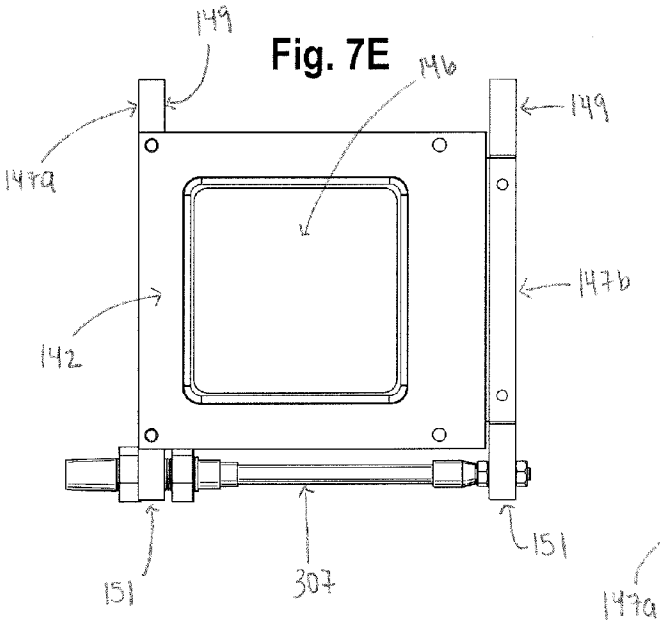
FIG. 7E shows a top view of a valve of the device of FIG. 1 in the closed position.

As shown in FIGS. 6 and 7C, the bottom 106 of the hopper 102 is connected to an adaptor 140. The adaptor 140 includes a top portion 142, a bottom portion 144, and a valve 146 positioned between the top portion 142 and the bottom portion 144. The top portion 142 of the adaptor 140 is preferably rectangular or square shaped and includes a top opening, a bottom opening, and a conduit between the top and bottom openings, as shown in FIGS. 7E-7F.

The shape of the top and bottom openings and the conduit of the top portion 142 of the adaptor 140 are the same shape as the bottom 106 of the hopper 102. For example, the bottom 106 of the hopper 102, as shown in FIG. 3, has a square shape, and therefore the top and bottom openings and the conduit of the top portion 142 of the adaptor 140 will also have a square shape, as shown in FIGS. 7E-7F. However, if the bottom 106 of the hopper 102 has a circular shape, then the top and bottom openings and the conduit of the top portion 142 of the adaptor 140 will also have a circular shape. The dimensions of the top and bottom openings and the conduit of the top portion 142 may be slightly larger than the dimensions of the bottom 106 of the hopper 102 so that the bottom 102 of the hopper 102 may fit in the top opening and part of the conduit of the top portion 142. The material 204 may flow through the bottom opening 106*a* of the hopper 102 and through the top and bottom openings and the conduit of the top portion 142 of the adaptor 140. One or more gaskets (not shown), such as an O-ring or other elastomeric gasket with a square or circular shape, may be positioned within or near the top opening and the bottom opening of the top portion 142 of the adaptor 140 to create a seal and prevent leakage of the material 204.

The bottom portion 144 of the adaptor 140 includes a first part 144*a* and a second part 144*b*, as shown in FIG. 7C. The first part 144*a* and second part 144*b* are integral with one another. The first part 144*a* has the same shape as the top portion 142 of the adaptor, for example, a generally square shape. The first part 144*a* of bottom portion 144 has a top opening, a bottom opening, and a conduit between the top and bottom openings. The top opening may have a generally square shape and the bottom opening may have a generally circular shape. Thus, the walls of the conduit may taper from the square shape of the top opening to the circular shape of the bottom opening, as shown in FIG. 7F.

The second part 144*b* of the bottom portion 144 of the adaptor 140 has a circular shape and is hollow. The diameter of the bottom opening of the first part 144*a* of the bottom portion 144 is the same as the inner diameter of the second part 144*b* of the bottom portion 144. Thus, the channel within the bottom portion 144 of the adaptor 144, starting from the top opening of the first part 144*a*, through the conduit and the bottom opening of the first part 144*a*, and then through the second part 144*b*, begins with a generally square shape and transitions to a generally circular shape.

As described above, the valve 146 is positioned between the top portion 142 and the first part 144*a* of the bottom portion 144 of the adaptor 140 and includes a plate. The valve 146 may also slide through a slot located on the bottom surface of the top portion 142 of the adaptor 140. The valve 146 is a mechanically actuated valve that regulates the flow of material 204 from the hopper 102 through the adaptor 140 and shuts off the flow of material 204. The valve 146 may be connected to the lever assembly 303 of the machine 300 via the cable 309. The forward and backward movement of the lever 305 of the lever assembly 303 manipulates the cable 309 within the rod 307, which in turn manipulates the valve 146.

The first part 144*a* of the bottom portion 144 of the adaptor 140 may also include an angled cutout 143 to position a blade wiper below the valve 146. The blade wiper (not shown) is positioned along the angled cutout 143 such that when the valve 146 moves out of the adaptor 140, the blade wiper may scrap and remove any excess material 204 off of the valve 146 and prevent any buildup of material 204 on the valve 146.

As shown in FIGS. 7E and 7F, the adaptor 140 also includes at least two clamps 147*a*, 147*b* positioned on opposite sides of the adaptor 140 and on opposite sides of the valve 146. The clamps 147*a*, 147*b* also facilitate actuation of the valve 146 and the cable 309 within the rod 307. Specifically, the clamps 147*a*, 147*b* may include a generally H-shape including a length and first and second ends 149, 151 each comprising an opening, as shown in FIG. 7C. As shown in FIGS. 7E and 7F, the clamp 147*a* may be stationary and not connected to the valve 146. The rod 307 may pass through the opening of the second end 151 of the clamp 147*a* and be mechanically fastened or connected to the clamp 147*a*, such as with screws, bolts, nuts, and/or washers, on opposite sides of the second end 151 of the clamp 147*a* to prevent movement of the rod 307. The clamp 147*b* may be connected to the valve 146 and not stationary. The cable 309, which exits the end of the rod 307, may pass through the opening of the second end 151 of the clamp 147*b*, and the cable 309 may be mechanically connected to the clamp 147*b*, such as with screws, bolts, nuts, and/or washers, on opposite sides of the second end 151 of the clamp 147*b*.

As shown in FIGS. 1 and 7E, when the lever 305 of the lever assembly 303 is pulled back, the cable 309 within the rod 307 also pulls back, which in turns pulls the valve 146 into the adaptor 140 via the clamp 147*b* and shuts off the flow of material 204 through the adaptor 140, also known as the closed position of the valve 146. When the lever 305 of the lever assembly 303 is pushed forward, the cable 309 also pushes forward, which in turn pushes the valve 146 out of the adaptor 140 via the clamp 147*b* and allows the material 204 to flow through the adaptor 140, also known as the open position of the valve 146 shown in FIG. 7F. The valve 146 may be fully inserted into the adaptor 140 to shut off the flow of the material 204 through the adaptor 140, partially inserted to regulate the flow of the material 204, or removed from the adaptor 140 as to not block the flow of any material 204 through the adaptor 140. Other types of valves 146 may also be used, such as a pinch valve, a gate valve, a hydraulic valve, a pneumatic valve, or an electric valve.

A second rod and cable (not shown) may also be connected to the lever assembly 303 to facilitate actuation of the valve 146. The second rod and cable may operate in the same fashion as the rod 307 and cable 309 on the opposite side of the adaptor 140. For example, the second rod may pass through the opening of the first end 149 of the clamp 147*a* and be mechanically fastened or connected to the clamp 147*a*, such as with screws, bolts, nuts, and/or washers, on opposite sides of the first end 149 of the clamp 147*a* to prevent movement of the second rod. The second cable, which exits the end of the second rod, may pass through the opening of the first end 149 of the clamp 147*b*, and the second cable may be mechanically connected to the clamp 147*b*, such as with screws, bolts, nuts, and/or washers, on opposite sides of the first end 149 of the clamp 147*b*. Thus, when the lever 305 of the lever assembly 303 is pulled back, both the second cable and the cable 309 may pull back, which in turn pulls the valve 146 into the adaptor 140 via the clamp 147*b*. When the lever 305 of the lever assembly 303 is pushed forward, both the second cable and the cable 309 push forward, which in turn pushes the valve 146 out of the adaptor 140 via the clamp 147*b*.

The device 100 also includes a flexible tube 148 that is connected to the adaptor 140, as shown in FIG. 7C. The flexible tube 148 includes a first end, a second end, an inner diameter, an outer diameter, and a length and is capable of being compressed and elongated. The first end of the flexible tube 148 is connected to the second part 144*b* of the bottom portion 144 of the adaptor 140. The inner diameter of the flexible tube 148 may be the same or slightly larger than the outer diameter of the second part 144*b* such that the tube 148 fits over the outer diameter of the second part 144*b* of the bottom portion 144 of the adaptor 140. The first end of the flexible tube 148 is connected to the second part 144*b* of the bottom portion 144 of the adaptor 140 via a mechanical fastening belt 150, such as a hose clamp known in the art. The second end of the flexible tube 148 is connected to a plate portion 152 of the device 100, described in greater detail below.

The material 204 may flow through the adaptor 140 and the flexible tube 148 and toward the plate portion 152. The flexible tube 148 may be replaced as needed over time and after repeated usage of the device 100. The flexible tube 148 may also include one or more springs (not shown) within the flexible tube 148 to facilitate movement of the flexible tube 148 and absorb energy. The material of the flexible tube 148 may include any flexible hose that is capable of collapsing under deflection without deforming and blocking the flow of material 204. For example, the flexible tube 148 may include a collapse-resistant rubber or metal hose that has a spring core to maintain its shape.

The plate portion 152 of the device 100 is the part of the device 100 that contacts the ground during the reinstatement process, as shown in FIG. 1. The machine 300 may lower the device 100 so that the plate portion 152 makes positive contact with the pavement 202. The gravitational weight of the device 100, in particular when the hopper 102 is filled with material 204, applies a force to the plate portion 162 that helps the plate portion 152 maintain positive contact with the pavement 202 during operation, even when the surface of the pavement 202 is uneven or angled.

Figure 7G:
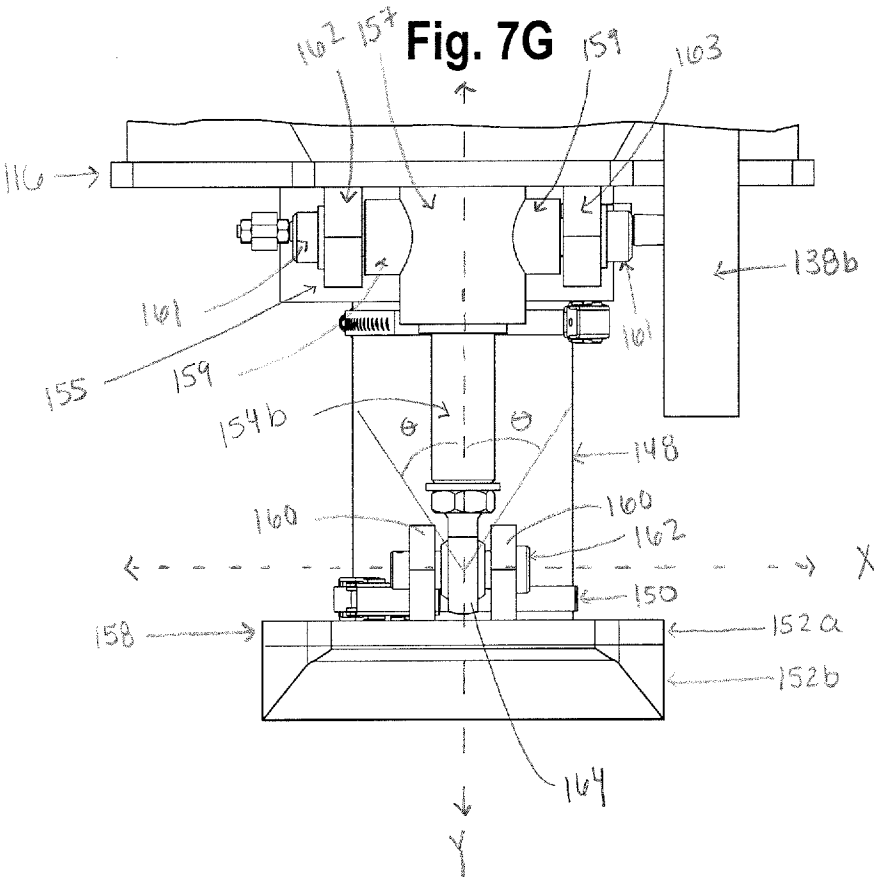
FIG. 7G shows a side view of one of the shafts of the device of FIG. 1.

The plate portion 152 is flexible and dynamic via a pair of shafts 154*a*, 154*b*, described in greater detail below, and the flexible tube 148 that allow the plate portion 152 to move to adapt to the surface of the pavement 202 to maintain positive contact with the pavement 202, such as when the surface of the pavement 202 is uneven or angled. Specifically, the shafts 154*a*, 154*b* and the flexible tube 148 allow the plate portion 152 to move up and down a vertical axis Y and also allow for some pivoting or deflection of the plate portion 152 from the vertical axis Y, as shown in FIG. 7G. The plate portion 152 may pivot or deflect from the vertical axis Y at the angle θ shown in FIG. 7G, which may be approximately up to 15 degrees in either direction, before the interfering with a set of parallel plates 160, described in more detail below. For example, even if the machine 300 and/or the hopper 102 are angled with respect to the surface of the pavement, the dynamic and flexible features of the plate portion 152 allow the plate portion 152 to maintain positive contact with the pavement 202. The flexible and dynamic features of the plate portion 152 also prevent damage to the plate portion 152 when traversing along the pavement 202.

The plate portion 152 includes a connecting plate 152*a* and a skid plate 152*b*, as shown in FIG. 7C. The material of the connecting plate 152*a* may include steel. The connecting plate 152*a* includes a first portion 156 and a second portion 158, which are integral with one another. The first portion 156 is a circular shaped conduit that includes an outer diameter that is the same as or slightly smaller than the inner diameter of the flexible tube 148 to allow the second end of the flexible tube 148 to slide over and around the first portion 156 of the connecting plate 152*a*. The flexible tube 148 is connected to the first portion 156 of the connecting plate 152*a* via another mechanical fastening belt 150, such as a hose clamp known in the art.

The second portion 158 of the connecting plate 152*a* is a plate that includes a circular top opening, a circular bottom opening, and a circular conduit between the top and bottom openings that correspond with the circular shaped first portion 156 of the connecting plate 152*a*. The inner diameter of the first portion 156 is the same as the diameter of the top and bottom openings and the conduit of the second portion 158 of the connecting plate. Thus, the channel within the connecting plate 152*a*, starting from the first portion 156 and then through the top opening, the conduit, and the bottom opening of the second portion 158, has a continuous circular shape with the same diameter throughout the channel to allow material 204 to flow through the connecting plate 152*a*.

Figure 5:
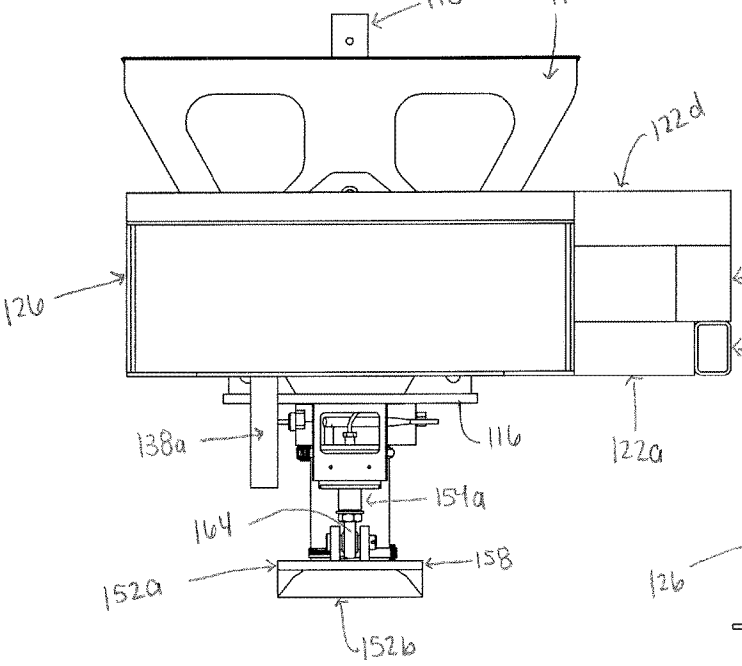
FIG. 5 shows a rear view of the device of FIG. 1.

The shafts 154*a*, 154*b* are connected to the second portion 158 of the connecting plate 152*a* via two yokes, clevises or two sets of parallel plates 160 positioned on the top surface of the second portion 158 of the connecting plate 152*a*, as shown in FIGS. 5, 7C and 7G, and on opposite ends of the second portion 158. Each of the shafts 154*a*, 154*b* includes a first end and a second end.

The first end of each shaft 154*a*, 154*b* includes a mechanically connected, via screws, bolts, nuts, and/or washers, or integral, via welding, bonding, or adhesive, bearing 164, as shown in FIGS. 5 and 7G. The bearing 164 allows a shaft or clevis pin 162 to slide through the bearing 164, and the shaft 162 slides through holes in the parallel plates 160 and then may be connected to the parallel plates 160 via nuts and washers. This configuration creates a gimbal effect and allows for movement of the plate portion 152 as described above. In an alternative embodiment, the first end of each shaft 154*a*, 154*b* may include a ball joint to connect each shaft 154*a*, 154*b* to the connecting plate 152*a*. The second end of each shaft 154*a*, 154*b* is positioned through holes in the bottom plate 116 of the sub-frame assembly, which allow the shafts 154*a*, 154*b* to move up and down the vertical axis Y through the bottom plate 116 of the sub-frame assembly.

To maintain the position of the shafts 154*a*, 154*b* within the center of the holes in the bottom plate 116, each shaft 154*a*, 154*b* passes through a support assembly 155 prior to entering the hole within the bottom plate 116. As shown in FIG. 7G, the support assembly 155 includes a cylinder 157, two connecting cylinders 159, a rod 161 within each connecting cylinder 159, and a yoke, clevis or two parallel plates 163 positioned on the bottom surface of the bottom plate 116 of the sub-frame assembly, as shown in FIG. 7G.

The parallel plates 163 each include a hole for positioning each rod 161 within the hole of each plate 163. Each rod 161 may be mechanically connected to each plate 163 via nuts and washers to prevent movement of the rod 161 and respective connecting cylinder 159. Each connecting cylinder 159 may be integral with the cylinder 157 via a weld, bond or adhesive. Within each cylinder 157, each shaft 154*a*, 154*b* may move freely along the vertical axis Y within each cylinder 157. The shafts 154*a*, 154*b* may also be lubricated with oil-embedded brass bushing or other lubricants to facilitate movement of the shafts 154*a*, 154*b* within each cylinder.

As shown in FIGS. 4 and 7C, the skid plate 152*b* of the plate portion 152 may be connected to the connecting plate 152*a* via an integral connection, such as a weld, bond, or adhesive or via a mechanical connection, such as screws, bolts, nuts, and/or washers. The material of the skid plate 152*b* may include a nylon-based plastic, abrasion-resistant steel, or an adhesive and chemical resistant plastic, such as high-density polyethylene.

The skid plate 152*b* has a top opening, a bottom opening 166, and a conduit 168 between the top opening and bottom opening 166. The shape of the top opening, the bottom opening 166, and the conduit 168 is designed to have the same shape as the micro-trench 200, which facilitates precise placement of the material 204 into the micro-trench 200. For example, if the micro-trench 202 has a rectangular shape and a width of two inches, then the top opening, the bottom opening 166, and the conduit 168 of the skid plate 152*b* will also include a rectangular shape and have a width of two inches. As the length of the micro-trench 202 may be significant, i.e. miles, the length of the top opening, the bottom opening 166, and the conduit 168 may vary. In one embodiment, the length may be six inches. Thus, material 204 may flow through the skid plate 152*b* to the micro-trench 200 to backfill the micro-trench 200 with material 204, as shown in FIG. 1. The bottom surface 170 of the skid plate 152*b*, as shown in FIG. 7C, that contacts the ground is also generally flat to traverse along the pavement 202 and also levels out the material 204 after it is poured into the micro-trench 204 to restore the pavement 202 to its original surface level prior to the micro-trenching.

The device 100 may also include at least two cameras 172. The cameras 172 may be connected to the display 302 of the machine 300 via the cables 306 and allows the feedback from the cameras 172 to be displayed on the display 302 for the operator of the machine 300. The cameras 172 provide the operator of the machine 300 with a visual of the position of the plate portion 152 with respect to the micro-trench 202 to facilitate precise placement of the plate portion 152 over the micro-trench 202 during operation. The cameras 172 also provide the operator of the machine 300 with a visual of the amount and level of material 204 within the micro-trench 202 during operation to ensure that the micro-trench 202 is properly filled without underfilling or overfilling the micro-trench 202.

As shown in FIGS. 6 and 7D, each camera 172 is positioned within a covering mount 174 that protects the camera 172. The covering mount 174 is connected to the bottom plate 116 of the sub-frame assembly via an integral connection, such as a weld, bond, or adhesive or via a mechanical connection, such as screws, bolts, nuts, and/or washers. One of the cameras 172 is positioned to view the front 176 of the plate portion 152 and the micro-trench 202, and the other camera 172 is positioned to view the rear 178 of the plate portion 152 and the micro-trench 202. The positioning of the cameras 172 allows the operator of the machine 300 to visually see the location of the plate portion 152 relative to the micro-trench 202. The cameras 172 may also include lights to allow the operator of the machine 300 and device 100 to utilize the device 100 in environments that are dark, such as during non-daylight hours, in tunnels or under bridges.

Advantageously, the present embodiments increase the efficiency of reinstatement of a micro-trench by using a device that is machine powered to provide for faster deployment of the back-fill material within the micro-trench. For example, the device may be able to reinstate 500 to 5,000 feet per day of a micro-trench. The increased efficiency allows for faster deployment and the pavement to be restored to its original condition faster, which minimizes disruptions to traffic, pedestrians and residents.

As another advantage, the present embodiments also provide for more controlled, precise and proper reinstatement of the micro-trench. For example, the device includes a plate portion that levels the back-fill material within the micro-trench so the pavement level is restored to its original condition prior to micro-trenching. The plate portion also includes a conduit and bottom opening that are the same shape and have the same or similar width as the micro-trench to pour the material in a controlled and precise manner into the micro-trench and not outside of the micro-trench. The plate portion is also dynamic and flexible due to shafts and a flexible tube to ensure the plate portion maintains positive contact with the pavement during operation even if the surface of the pavement is uneven or angled. The cameras, and the lights on the cameras, also allow the operator of the machine powering the device to know where the plate portion is located in relation to the micro-trench and to move the device to properly position the plate portion over the micro-trench. Also, the valve portion allows the operator of the machine and the device to regulate the flow of material to the micro-trench.

It will be appreciated by those skilled in the art that changes could be made to the embodiments described above without departing from the broad inventive concept therefore. It is understood, therefore, that this invention is not limited to the particular embodiments disclosed, but it is intended to cover modifications within the spirit and scope of the present invention as defined by the claims.

The invention claimed is:

1. A device for reinstatement of a micro-trench comprising:

a hopper comprising a first opening and a second opening, wherein the first opening is at a location higher than the second opening within the hopper;

a valve portion connected to the second opening of the hopper;

a tube connected to the valve portion; and a dynamic plate portion comprising a top opening, a bottom opening, and a conduit between the top and bottom openings, the top opening connected to the tube and the bottom opening comprising a length and a width, whereby the tube allows the dynamic plate portion to move.

2. The device of claim 1, wherein the valve portion comprises a top portion, a bottom portion, and a valve positioned between the top portion and the bottom portion, the top portion connected to the second opening of the hopper and the bottom portion connected to the tube.

3. The device of claim 2, wherein the valve of the valve portion is mechanically-actuated.

4. The device of claim 1, wherein the device is machine-powered.

5. The device of claim 1, wherein the device further comprises a frame support; and wherein the hopper is positioned within the frame support and is rotatably connected to the frame support.

6. The device of claim 5, wherein the device further comprises one or more shafts connected to the frame support and the plate portion.

7. The device of claim 5, wherein the device further comprises a camera mounted to the frame support.

8. The device of claim 1, wherein the device is non-machine-powered.

9. A machine-powered device for reinstatement of a micro-trench comprising:

a hopper comprising a first opening and a second opening, wherein the second opening is at a location lower than the first opening within the hopper;

a valve portion connected to the second opening of the hopper;

a flexible tube connected to the valve portion; and a plate portion comprising a top opening, a bottom opening, and a conduit between the top and bottom openings, the top opening connected to the flexible tube, whereby the flexible tube allows the dynamic plate portion to move.

10. The device of claim 9, wherein the valve portion comprises a top portion, a bottom portion, and a valve positioned between the top portion and the bottom portion, the top portion connected to the second opening of the hopper and the bottom portion connected to the tube.

11. The device of claim 10, wherein the valve of the valve portion is mechanically-actuated.

12. The device of claim 9, wherein the device further comprises a frame support; and wherein the hopper is positioned within the frame support and is rotatably connected to the frame support.

13. The device of claim 12, wherein the device further comprises one or more shafts connected to the frame support and the plate portion; and wherein the plate portion is dynamic.

14. The device of claim 12, wherein the device further comprises a camera mounted to the frame support.

15. The device of claim 9, wherein the bottom opening of the plate portion comprises a length and a width.

16. A machine-powered device for reinstatement of a micro-trench comprising:

a frame support;

a hopper positioned within the frame support and rotatably connected to the frame support;

a valve portion connected to the hopper;

a flexible tube connected to the valve portion; and a plate portion comprising a top opening, a bottom opening, and a conduit between the top and bottom openings, the top opening connected to the flexible tube and the bottom opening comprising a length and a width, whereby the flexible tube allows the dynamic plate portion to move.

17. The device of claim 16, wherein the valve portion comprises a top portion, a bottom portion, and a valve positioned between the top portion and the bottom portion, the top portion connected to the hopper and the bottom portion connected to the tube.

18. The device of claim 17, wherein the valve of the valve portion is mechanically-actuated.

19. The device of claim 16, wherein the device further comprises a camera mounted to the frame support.

20. The device of claim 16, wherein the device further comprises one or more shafts connected to the frame support and the plate portion; and wherein the plate portion is dynamic.

21. The device of claim 20, wherein the frame support comprises a mount.

* * * * *